US010692671B2

(12) United States Patent
Kralik

(10) Patent No.: US 10,692,671 B2
(45) Date of Patent: Jun. 23, 2020

(54) SWITCHING DEVICE WITH ARC EXTINGUISHING DEVICE AND ARC GUIDE

(71) Applicant: Schaltbau Gmbh, Munich (DE)

(72) Inventor: Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 16/179,778

(22) Filed: Nov. 2, 2018

(65) Prior Publication Data

US 2019/0139728 A1 May 9, 2019

(30) Foreign Application Priority Data

Nov. 3, 2017 (DE) ..... 10 2017 125 685

(51) Int. Cl.
*H01H 1/20* (2006.01)
*H01H 9/34* (2006.01)
(Continued)

(52) U.S. Cl.
CPC ..... *H01H 33/08* (2013.01); *H01H 9/342* (2013.01); *H01H 9/346* (2013.01); *H01H 9/36* (2013.01);
(Continued)

(58) Field of Classification Search
CPC ..... H01H 33/08; H01H 9/342; H01H 9/346; H01H 9/36; H01H 9/362; H01H 9/446; H01H 9/46; H01H 9/345
(Continued)

(56) References Cited

U.S. PATENT DOCUMENTS 3,560,685 A 2/1971 Bailey
7,417,520 B2 * 8/2008 Kralik ..... H01H 9/34 200/10
(Continued)

FOREIGN PATENT DOCUMENTS

EP 3 048 626 A1 7/2016
GB 2 163 293 A 2/1986
(Continued)

OTHER PUBLICATIONS

European Search Report dated Feb. 21, 2019 in related European Patent Application No. 18203408.2, (seven pages).
(Continued)

*Primary Examiner* — Edwin A. Leon
*Assistant Examiner* — William A Bolton
(74) *Attorney, Agent, or Firm* — Kilpatrick Townsend & Stockton LLP

(57) ABSTRACT

Switching devices having a contact point, and an arc extinguishing chamber are used to blow switch arcs. The arc extinguishing chamber may have an exit opening through which plasma, generated inside the switching device by a switch arc developing when the contact point opens, exits out of the switching device. Inside the extinguish chamber a first arc guide plate may be provided that extends from the contact point toward the exit opening and which guides and stretches the switch arc. The switch arc may be initially stretched beyond the dimensions of the exit opening by the first arc guide plate and then the stretching may be reduced to be within the dimensions of the exit opening by an arc guide pin projecting from the first arc guide plate.

10 Claims, 5 Drawing Sheets

Figure 1:
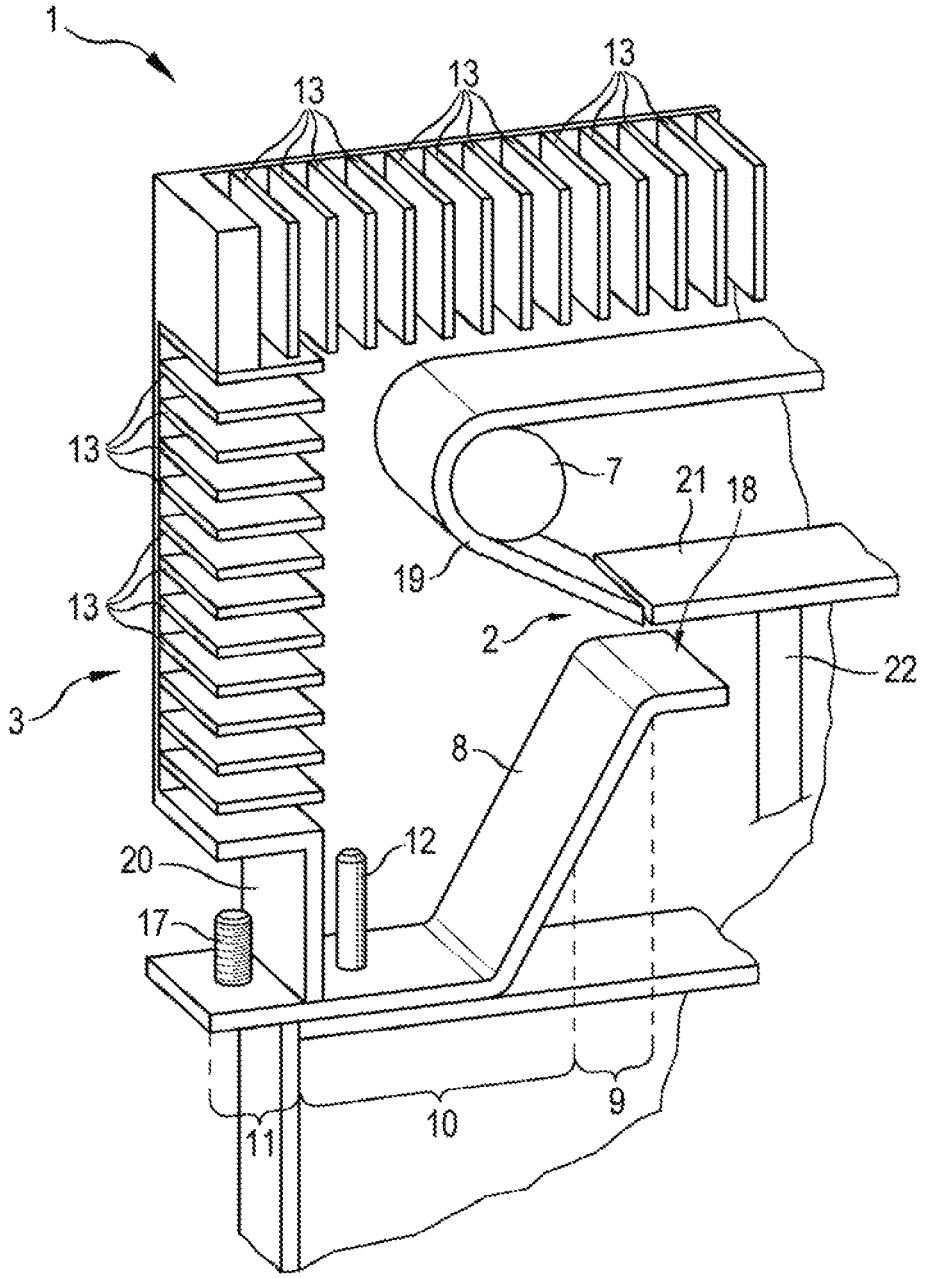

(51) Int. Cl.

| | |
|---|---|
| ***H01H 9/36*** | (2006.01) |
| ***H01H 9/44*** | (2006.01) |
| ***H01H 9/46*** | (2006.01) |
| ***H01H 33/08*** | (2006.01) |
| ***H01H 50/54*** | (2006.01) |

(52) U.S. Cl.
CPC ..... *H01H 9/362* (2013.01); *H01H 9/446* (2013.01); *H01H 9/46* (2013.01); *H01H 1/20* (2013.01); *H01H 9/443* (2013.01); *H01H 50/546* (2013.01)

(58) Field of Classification Search
USPC ..... 218/146, 16, 22, 23, 26, 30, 34, 36, 40, 218/1; 200/10, 400
See application file for complete search history.

(56) References Cited

U.S. PATENT DOCUMENTS 7,915,985 B2 * 3/2011 Schmitz ..... H01H 9/443 218/22
8,097,824 B2 * 1/2012 Kil ..... H01H 9/36 218/149
8,368,492 B1 * 2/2013 Theisen ..... H01H 9/36 218/15
8,502,102 B2 * 8/2013 Eriksson ..... H01H 9/40 218/149
8,937,519 B2 * 1/2015 Gerving ..... H01H 1/20 335/132

FOREIGN PATENT DOCUMENTS

| | | | |
|---|---|---|---|
| KR | 10-2016-0090770 | A | 8/2016 |
| RU | 2 136 074 | C1 | 8/1999 |
| RU | 2457568 | C2 | 7/2012 |
| RU | 2672852 | C2 | 11/2018 |
| WO | 2011/147458 | A1 | 12/2011 |

OTHER PUBLICATIONS

Examination report of the corresponding German Patent Application No. 10 2017 125 685.7, dated Aug. 9, 2018 (six pages).
Examination report, dated Aug. 13, 2019, of the corresponding Russian patent application (six pages).
Korean Search Report dated Sep. 24, 2019 in related Korean Patent Application No. 10-2018-0133693.

* cited by examiner

SWITCHING DEVICE WITH ARC EXTINGUISHING DEVICE AND ARC GUIDE

This application claims priority to German Patent Application No. 10 2017 125 685.7, filed Nov. 3, 2017, the disclosure of which is incorporated by reference herein.

The present invention relates to a switching device according to the preamble of the independent claim 1.

A generic switching device comprises at least one contact point, an arc extinguishing chamber assigned to the contact point, and an arc blow device assigned to the contact point. The arc extinguishing chamber comprises an exit opening through which plasma, which is generated inside the switching device by a switch arc developing when the contact point opens, can exit out of the switching device, the exit opening having a clearance dimension and defining an exit plane. The arc blow device is provided for generating a magnetic blow field by which the switch arc developing when the contact point opens is blown away from the contact point towards the exit opening. Furthermore, the switching device comprises at least one first arc guide plate which extends from the contact point towards the exit opening and by which the switch arc is guided and stretched on the way from the contact point to the exit opening, the first arc guide plate comprising a first portion and a second portion within the arc extinguishing chamber between the contact point and the exit plane, the first portion of the first arc guide plate being arranged proximal to the contact point, and the second portion of the first arc guide plate being arranged distal to the contact point.

A switching device according to the preamble of the independent claim 1 is for instance known from EP 3048626 A1.

The switch arc developing when the contact point opens is stretched inside the switching device or inside the arc extinguishing chamber in order to reliably extinguish the switch arc using the extinguishing elements normally provided in the exit opening of the arc extinguishing chamber. Usually two arc guide plates are provided for this purpose, which diverge relatively strongly starting from the contact point in order to quickly stretch the switch arc. Usually, the switch arc is stretched within the switching device to the clearance dimension of the exit opening of the arc extinguishing chamber. Due to certain constructive boundary conditions, it is sometimes desirable to be able to keep the exit opening smaller than the distance between the exit-side ends of the two arc guide plates, especially if one of the two arc guide plates is led out of the housing of the switching device as a terminal contact, as is the case with an embodiment of the published European patent application EP 3048626 A1. Nevertheless, in order not to stretch the switch arc within the switching device beyond the clearance dimension of the exit opening, the arc guide plate led out of the housing is bent in steps in this embodiment, which is difficult with particularly thick arc guide plates of correspondingly powerful switching devices and is only possible by accepting high bending radii and high bending tolerances.

It is therefore the object of the present invention to indicate a switching device of the generic type that enables reliable extinguishing of the switch arc and can be produced simply and inexpensively.

The object is solved by the features of the independent claim 1. Accordingly, in the case of a switching device according to the preamble of the independent claim 1, a solution of the object according to the invention exists if the second portion of the first arc guide plate extends beyond the exit opening in a direction parallel to the exit plane, so that the switch arc is stretched by the second portion of the first arc guide plate at least at one end of the switch arc beyond the clearance dimension of the exit opening, wherein an arc guide pin projecting from the second portion of the first arc guide plate is arranged in front of the exit opening, by which arc guide pin the switch arc is shortened again in front of the exit opening.

The solution according to the invention offers the advantage that the switch arc can be stretched particularly quickly and strongly within the switching device, which promotes reliable extinguishing of the switch arc. At the same time, the arc guide plate can be led out of the housing of the switching device at a distance from the exit opening of the arc extinguishing chamber, which may sometimes be necessary due to certain constructive boundary conditions. The solution according to the invention prevents undesirable plasma concentrations within the switching device. Even arc guide plates with considerable material thickness can be manufactured relatively easily, inexpensively and precisely, since a step-shaped course of the arc guide plate is not necessary. The arc guide pin, which is provided according to the invention, is made of an electrically conductive material, as is the arc guide plate. The arc guide pin can be made of the same material as the arc guide plate. For example, arc guide plate and arc guide pin can be made of copper.

The clearance dimension of the exit opening of the arc extinguishing chamber is measured in the direction of the longitudinal extension of the switch arc projected onto the exit plane. On the side opposite the first arc guide plate, the switch arc need also not be stretched compulsorily beyond the exit opening. For the purposes of this application, stretching the switch arc beyond the clearance dimension of the exit opening is also to be understood as the case in which the switch arc is stretched to such an extent only on the side of the first arc guide plate that it does not, so to speak, fit through the exit opening on this side.

Advantageous embodiments of the present invention are the subject of the sub-claims.

The arc guide pin can be manufactured particularly easily and inexpensively if the arc guide pin is a simple cylindrical bolt. However, the arc guide pin can also have different other forms. For example, also a bolt having a hexagonal cross section can be used. Such bolts are available on the market as standard parts and are therefore also inexpensive. For example, also an elongated metal strip can be used as arc guide pin. According to a particularly preferred embodiment of the present invention, the arc guide pin is a bracket that extends transversely to the first arc guide plate and the free ends of which are attached to the first arc guide plate. Preferably, the bracket has a U-shape. Both free ends of the bracket can for example be screwed to the first arc guide plate. The bracket extends preferably transversely to the first arc guide plate over at least 50% of the width of the first arc guide plate.

According to a preferred embodiment of the present invention, the arc guide pin projects perpendicularly from the second portion of the first arc guide plate. This embodiment results in a simple design and an effective shortening of the switch arc immediately before the switch arc is blown into the exit opening.

According to another particularly preferred embodiment of the present invention, the arc guide pin ends in a direction parallel to the exit plane, approximately at the level of the exit opening, so that the switch arc is shortened by the arc guide pin to the clearance dimension of the exit opening. In this embodiment, undesirable plasma concentrations inside the switching device are most effectively avoided, wherein, nevertheless, the switch arc is or remains optimally stretched before entering the exit opening.

According to another preferred embodiment of the present invention, the arc guide pin comprises a guide plate-side end with a threaded portion, wherein the threaded portion is screwed to a corresponding internal thread of a bore in the first arc guide plate. This embodiment results in a particularly simple and cost-effective production or assembly.

According to another preferred embodiment of the present invention, the arc guide pin comprises a chamfer at its end facing away from the first arc guide plate. The chamfer prevents the arc guide pin at the upper end from being destroyed by the switch arc or from being subject to premature wear. With this embodiment, the arc guide pin is preferably configured as a bolt, further preferred as a simple cylindrical bolt.

According to another preferred embodiment of the present invention, the arc extinguishing chamber comprises a plurality of extinguishing elements, each of which is arranged spaced apart from one another in the exit opening, wherein the plasma generated by the switch arc inside the switching device can exit out of the exit opening between and through the extinguishing elements. This embodiment guarantees a particularly reliable extinguishing of the switch arc. At this point it should be mentioned that the exit opening is not infinitesimally small in relation to the main direction of movement of the switch arc and is, so to speak, limited to the exit plane but has a certain depth corresponding to the length of the extinguishing elements.

According to another particularly preferred embodiment of the present invention, the first arc guide plate comprises a third portion following the second portion, which is guided out of a housing of the switching device and at the same time forms a first terminal contact of the switching device. A connecting bolt of the first terminal contact, viewed in a direction parallel to the exit plane, is preferably arranged between the first arc guide plate and the exit opening. This embodiment characterizes a switching device according to the invention with a particularly compact design. The connecting bolt is preferably arranged below the extinguishing elements, which are located in a laterally arranged exit opening of the switching device.

According to another preferred embodiment of the present invention, a fixed contact of the contact point is part of the first arc guide plate, wherein the first portion of the first arc guide plate directly adjoins the fixed contact and is angled relative to the fixed contact so that the switch arc is stretched by the first portion, wherein at least a part of the second portion of the first arc guide plate is again angled relative to the first portion and extends substantially parallel to the fixed contact. This embodiment results in a particularly simple and cost-effective construction of the switching device according to the invention, in particular through the arc guide plate which is made integral with the fixed contact. Substantially parallel in this context means a maximum deviation of plus or minus 5°. It is particularly advantageous if the first arc guide plate has only two bends. Further preferably, the arc guide plate is more than 10 mm thick and further preferably wider than 30 mm. With this embodiment, it is particularly advantageous if the first arc guide plate only has to be bent twice.

According to a further embodiment of the present invention, the switching device also comprises a second arc guide plate, wherein first and second arc guide plates diverge starting from the contact point in such a way that the switch arc is first stretched to a length which lies above the clearance dimension of the exit opening, wherein the switch arc in front of the exit opening is shortened again due to the arc guide pin.

Embodiments of the present invention shall be explained in more detail hereinafter with reference to the drawings.

Figure 2:
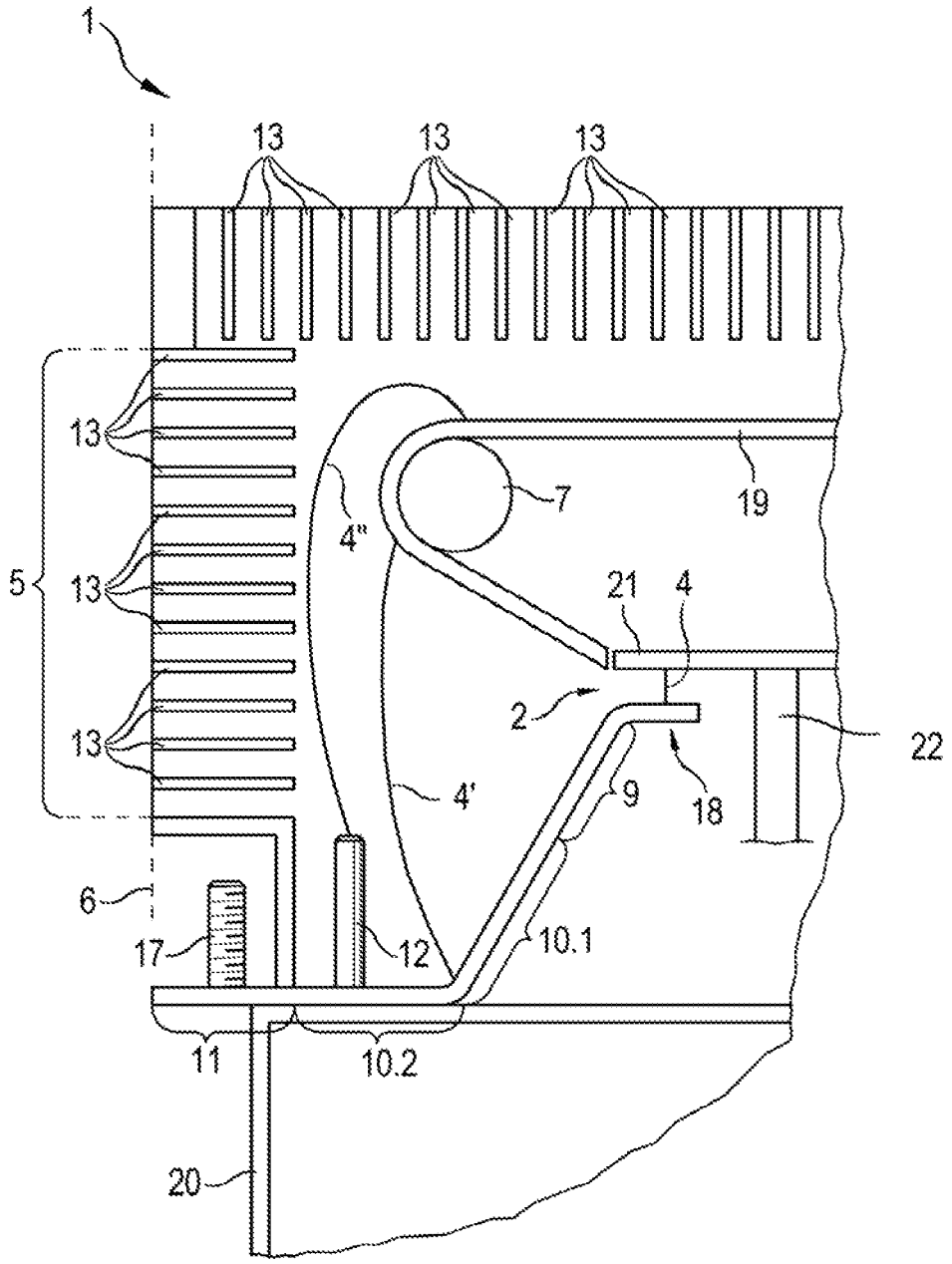
Figure 3:
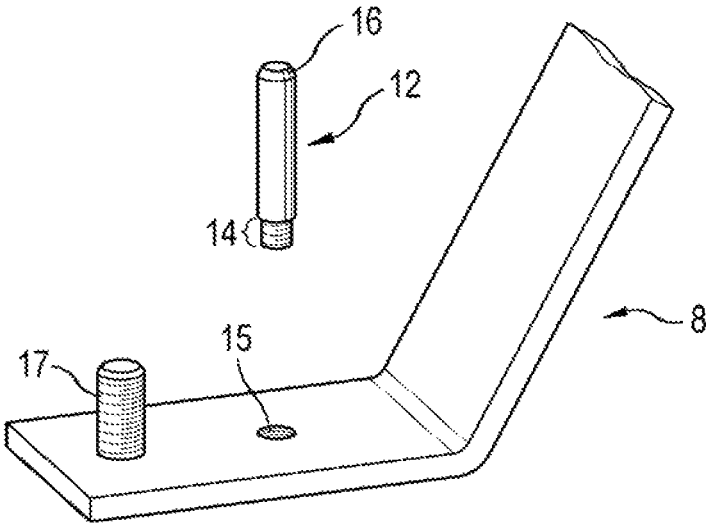
Figure 4:
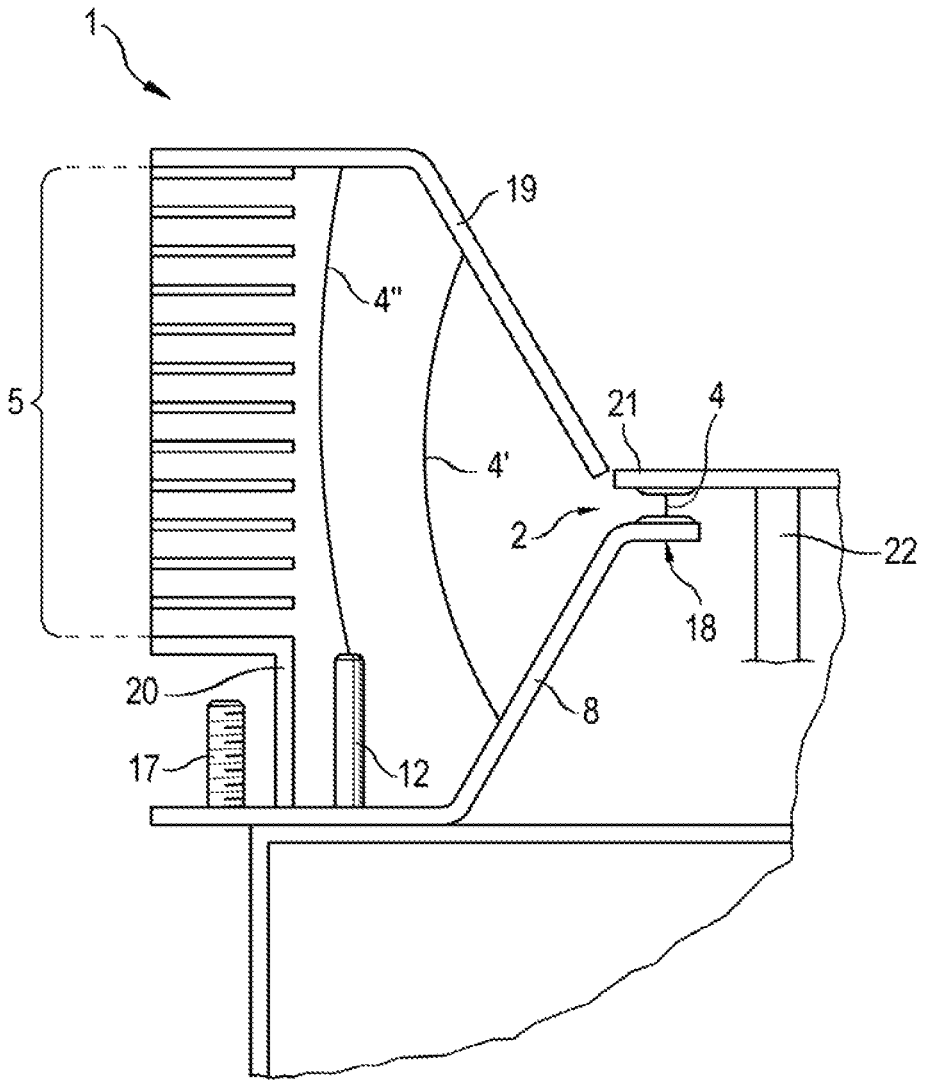
Figure 5:
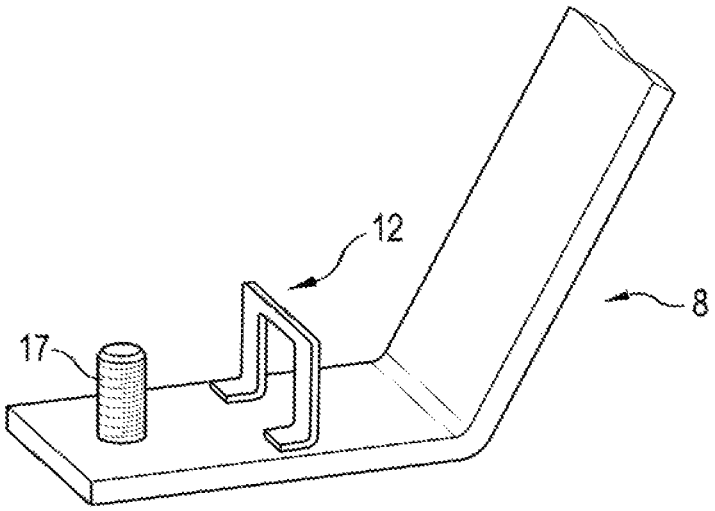

FIG. 1 shows a schematic oblique view of a switching device according to the invention according to a first embodiment with a housing shown in the opened state for reasons of illustration, FIG. 2 shows the switching device according to the invention of FIG. 1 in a side view, FIG. 3 shows a detail view of the first arc guide plate of the switching device according to the invention of FIGS. 1 and 2 with unscrewed arc guide pin, FIG. 4 shows a modification of the switching device according to the invention of FIGS. 1 to 3 in a side view, and FIG. 5 shows the detail view of FIG. 3 with an alternative arc guide pin.

FIG. 1 shows a switching device 1 according to the invention according to a first embodiment of the present invention in an oblique view. The side of the housing 20 of the switching device 1 facing the viewer is not shown to allow a view of the inner workings of the switching device 1.

A contact point 2 of the switching device 1 is arranged inside the housing 20. The contact point 2 comprises a fixed contact 18 and a movable contact 21 which is located on a contact bridge and which can be brought into contact with the fixed contact 18 by means of a drive (not shown) of the switching device according to the invention. Of the drive of the switching device, only the anchor rod 22 connected to the contact bridge is shown in the representation.

The contact point 2 is associated with an arc extinguishing chamber which on the left housing side comprises an exit opening 3 through which plasma, which is generated within the switching device by a switch arc developing when the contact point opens, can exit out of the switching device. In FIG. 2, which shows a side view of the switching device according to the invention, it can be seen that the exit opening has a clearance dimension 5 and defines an exit plane 6. The arc extinguishing chamber comprises a plurality of extinguishing elements 13, each of which is arranged spaced apart from one another in the exit opening in such a way that the plasma generated by the switch arc inside the switching device can exit between and through the extinguishing elements 13 out of the exit opening 3. As shown in FIGS. 1 and 2, the extinguishing chamber may comprise a further exit opening on the upper side of the switching device 1 according to the invention, in which further exit opening corresponding extinguishing elements 13 are also arranged. In the illustrated embodiment, the exit opening on the upper side of the housing is associated with both the contact point 2 shown and a second contact point not shown on the right-hand side of the contact bridge.

The contact point 2 is further associated with an arc blow device for generating a magnetic blow field by which the switch arc developing when the contact point opens is blown away from the contact point 2 towards the exit opening 3. The arc blow device comprises the blow magnet 7 shown in FIGS. 1 and 2 and two pole plates arranged parallel to each other and parallel to the image plane of FIG. 2.

The switch arc developing when the contact point opens is shown in FIG. 2 and marked there with reference sign 4. In order to guide and stretch the switch arc on the way from the contact point 2 to the exit opening 3, the switching device comprises a first arc guide plate 8 and a second arc guide plate 19. The two arc guide plates 8 and 19 diverge starting from the contact point in order to bring about the stretching of the switch arc. The first arc guide plate 8 is made in one piece with the fixed contact 18 and connects it to a terminal contact of the switching device 1. It comprises a first portion 9 directly adjoining the fixed contact 18, a second portion 10 directly adjoining the first portion and a third portion 11 directly adjoining the second portion. The portion 11 is led out of the housing 20 of the switching device according to the invention and at the same time forms a terminal contact of the switching device. It comprises an upwardly projecting connecting bolt which is located directly under the exit opening 3 or under the extinguishing elements 13 arranged in the exit opening 3. The connecting bolt 17 points upwards because, below the third portion 11 of the first arc guide plate 8, space must be provided due to the construction for corresponding attachments of the switching device 1 according to the invention. The exit opening 3 therefore does not extend downwards to the third portion of the first arc guide plate 8 but ends with some distance just above the connecting bolt 17.

FIG. 2 shows that the first portion 9 of the first arc guide plate 8 is angled with respect to the fixed contact 18 so that the switch arc 4 can be stretched on the way from the contact point to the exit opening. A first part 10.1 of the second portion 10 of the first arc guide plate 8 forms, so to speak, a pure extension of the first portion 9. The switch arc is stretched downwards by the first part 10.1 of the second portion beyond the clearance dimension 8 of the exit opening.

This stretched state of the switch arc is marked in FIG. 2 with reference sign 4'. A second part 10.2 of the second portion 10 of the first arc guide plate 8 is angled with respect to the first part 10.1 or with respect to the first portion 9 and extends at a right angle to the exit plane 6. The second part 10.2 of the second portion 10 thus extends parallel to the fixed contact 18. The lower base point of the switch arc is guided on the second part 10.2 of the second portion 10 of the arc guide plate 8 to shortly before the exit opening. Shortly before the exit opening there is arranged an arc guide pin 12 projecting from the second part 10.2, which shortens the switch arc again before the exit opening. The lower base point of the switch arc travels onto the tip of the arc guide pin 12 and stops there when the switch arc is driven into the extinguishing elements 13. The position of the switch arc directly in front of the extinguishing elements 13 is marked in FIG. 2 with reference sign 4". As the illustrations show, the arc guide pin 12 ends in a direction parallel to the exit plane 6, approximately at the level of the lower exit opening limit, so that the switch arc in the lower region is shortened by the arc guide pin to the clearance dimension of the exit opening.

The arc guide pin 12 is configured as a simple cylindrical bolt. FIG. 3 shows that the arc guide pin 12 has a guide plate-side end with a threaded portion 14, which can be screwed into the first arc guide plate 8 with a corresponding internal thread of a bore 15. The arc guide pin 12 can therefore be easily screwed to the guide plate 8. At its upper end facing away from the first arc guide plate 8, the arc guide pin 12 comprises a chamfer 16 to prevent a melting loss of the upper end of the arc guide pin 12 caused by the switch arc.

FIG. 4 shows a modification of the switching device 1 according to the invention of FIGS. 1 to 3 in a side view corresponding to FIG. 2. In this embodiment, the upper exit opening is not provided. The first arc guide plate 8 and the second arc guide plate 19 enclose the lateral exit opening like clamps, wherein the first arc guide plate is spaced from the lower end of the exit opening, as in the embodiment of FIGS. 1 and 2, and the second arc guide plate 19 runs directly towards the upper end of the exit opening. Here, too, the switch arc stretched inside the switching device is shortened to the clearance dimension 5 of the exit opening shortly before entry into the extinguishing elements.

FIG. 5 shows an alternative embodiment of the arc guide pin 12. The alternative embodiment of the arc guide pin can be used with both previously described embodiments of the invention. The alternative arc guide pin 12 of FIG. 5 is a U-shaped bracket that extends transversely to the first arc guide plate 8 and the free ends of which are attached to the first arc guide plate. Both free ends of the bracket at the guide plate-side end of the arc guide pin 12 can for example be screwed to the first arc guide plate. The bracket extends preferably transversely to the first arc guide plate over at least 50% of the width of the first arc guide plate.

The invention claimed is:

1. A switching device comprising:

a contact point, an arc extinguishing chamber assigned to the contact point, and comprising an exit opening configured for plasma, generated inside the switching device by a switch arc developed when in response to the contact point opening, to exit out of the switching device, wherein the exit opening comprises a clearance dimension between an upper end of the exit opening and a lower end of the exit opening, wherein the exit opening defines an exit plane parallel to the exit opening and defines a lower end plane parallel to the lower end of the exit opening and perpendicular to the exit plane, wherein the extinguishing chamber further comprises a plurality of extinguishing elements positioned within the exit opening and arranged spaced apart from one another, and wherein a depth of the exit opening is defined by a length of the extinguishing elements, an arc blow device assigned to the contact point and configured for generating a magnetic blow field by which the switch arc, developed in response to the contact point opening, is blown away from the contact point towards the exit opening, and a first arc guide plate within the extinguishing chamber and positioned on an exit opening side of the lower end plane, wherein the first arc guide plate extends from the contact point in a direction toward the exit opening and by which the switch arc is guided and stretched on a way from the contact point toward the exit opening, wherein the first arc guide plate comprises a first portion and a second portion within the arc extinguishing chamber, wherein the first arc guide plate extends from the contact point toward the exit plane, wherein the first portion of the first arc guide plate is arranged proximal to the contact point, and the second portion of the first arc guide plate is arranged distal to the contact point and on a non-opening side of the lower end plane, wherein the first arc guide plate extends from the first portion on the exit opening side of the lower end plane to the second portion on the non-exit opening side of the lower end plane so that the switch arc is stretched by the second portion of the first arc guide plate at least at one end of the switch arc beyond the clearance dimension of the exit opening, and wherein the switching device further comprises an arc guide pin on the non-exit opening side of the lower end plane and projecting from the second portion of the first arc guide plate toward the lower end plane, wherein the arc guide pin is configured to shorten the stretched switch arc prior to the switch arc being blown into the exit opening.

2. The switching device according to claim 1, characterized in that the arc guide pin projects perpendicularly from the second portion of the first arc guide plate.

3. The switching device according to claim 1, characterized in that the arc guide pin ends proximate to the lower end plane so that the switch arc is shortened by the arc guide pin to the clearance dimension of the exit opening.

4. The switching device according to claim 1, characterized in that the arc guide pin comprises a guide plate-side end with a threaded portion, wherein the threaded portion is screwed to a corresponding internal thread of a bore in the first arc guide plate.

5. The switching device according to claim 1, characterized in that the arc guide pin has a chamfered end facing away from the first arc guide plate.

6. The switching device according to claim 1, characterized in that the first arc guide plate comprises a third portion which adjoins the second portion and is guided out of a housing of the switching device and simultaneously forms a first terminal contact of the switching device.

7. The switching device according to claim 6, characterized in that a connecting bolt of the first terminal contact is arranged between the first arc guide plate and the exit opening.

8. The switching device according to claim 1, characterized in that a fixed contact of the contact point is part of the first arc guide plate, wherein the first portion of the first arc guide plate directly adjoins the fixed contact and is angled relative to the fixed contact, so that the switch arc is stretched by the first portion, wherein at least a part of the second portion of the first arc guide plate is again angled relative to the first portion and extends substantially in parallel with the fixed contact.

9. The switching device according to claim 1, characterized in that the switching device further comprises a second arc guide plate, wherein first and second arc guide plates diverge starting from the contact point so that the switch arc is stretched in opposite directions perpendicular to the lower end plane.

10. A switching device comprising:

a contact point, an arc extinguishing chamber assigned to the contact point, and comprising an exit opening configured for plasma, generated inside the switching device by a switch arc developed in response to the contact point opening, to exit out of the switching device, wherein the exit opening comprises a clearance dimension between an upper end of the exit opening and a lower end of the exit opening, wherein the exit opening defines an exit plane parallel to the exit opening and defines a lower end plane parallel to the lower end of the exit opening and perpendicular to the exit plane, wherein the extinguishing chamber further comprises a plurality of extinguishing elements positioned within the exit opening and arranged spaced apart from one another, and wherein a depth of the exit opening is defined by a length of the extinguishing elements, an arc blow device assigned to the contact point and configured for generating a magnetic blow field by which the switch arc, developed in response to the contact point opening, is blown away from the contact point towards the exit opening, and a first arc guide plate within the extinguishing chamber and positioned on an exit opening side of the lower end plane, wherein the first arc guide plate extends from the contact point in a direction toward the exit opening and by which the switch arc is guided and stretched on a way from the contact point toward the exit opening, wherein the first arc guide plate comprises a first portion and a second portion within the arc extinguishing chamber, wherein the first arc guide plate extends from the contact point toward the exit plane, wherein the first portion of the first arc guide plate is arranged proximal to the contact point, and the second portion of the first arc guide plate is arranged distal to the contact point and on a non-opening side of the lower end plane, wherein the first arc guide plate extends from the first portion on the exit opening side of the lower end plane to the second portion on the non-exit opening side of the lower end plane so that the switch arc is stretched by the second portion of the first arc guide plate at least at one end of the switch arc beyond the clearance dimension of the exit opening, wherein the switching device further comprises an arc guide pin on the non-exit opening side of the lower end plane and projecting from the second portion of the first arc guide plate toward the lower end plane, wherein the arc guide pin is configured to shorten the stretched switch arc prior to the switch arc being blown into the exit opening, and wherein the arc guide pin is a bracket that extends transversely to the first arc guide plate, and free ends of which are attached to the first arc guide plate.

* * * * *